United States Patent [19]

Takashima

[11] Patent Number: 5,027,470

[45] Date of Patent: Jul. 2, 1991

[54] DUSTLESS SURFACE TREATMENT MACHINE

[76] Inventor: Robert Takashima, 11949 Courtleigh Dr., Los Angeles, Calif. 90066

[21] Appl. No.: 594,007

[22] Filed: Oct. 9, 1990

[51] Int. Cl.[5] ..... A47L 5/30

[52] U.S. Cl. ..... 15/385; 51/273

[58] Field of Search ..... 15/385, 320; 51/273

[56] References Cited

U.S. PATENT DOCUMENTS

| | | | |
|---|---|---|---|
| 3,189,930 | 6/1965 | Tuthill | 15/385 X |
| 3,644,960 | 2/1972 | Danzig | 15/385 X |
| 4,148,110 | 4/1979 | Moen | 15/385 |
| 4,328,645 | 5/1982 | Sauer | 51/273 X |
| 4,729,195 | 3/1988 | Berger | 51/273 X |

FOREIGN PATENT DOCUMENTS

| | | | |
|---|---|---|---|
| 576560 | 5/1933 | Fed. Rep. of Germany | 15/385 |

*Primary Examiner*—Chris K. Moore

*Attorney, Agent, or Firm*—Henderson & Sturm

[57] ABSTRACT

A dustless surface treating machine including a housing having a sealed vacuum chamber. A drive attached to the housing operates a driving member that in turn drives a surface treating member that has a lower face in contact with the surface to be treated. Both the surface treating member and the driving member have a plurality of openings that communicate between the treated surface and the vacuum chamber. A vacuum source is operably attached to the vacuum chamber so that particles from the treated surface are drawn directly through the openings into the vacuum chamber and are collected in a receptacle.

10 Claims, 2 Drawing Sheets

DUSTLESS SURFACE TREATMENT MACHINE

TECHNICAL FIELD

This invention relates to surface treating machines, and more particularly to surface treating machines having a vacuum system for collecting dust particles.

BACKGROUND ART

Various surface treating machines including grinders, sanders, routers, polishers, buffers, and the like create dust particles that are both left on the treated surface and enter the ambient air in the work area. Dust collection systems of various designs have been used with both oscillating and rotary machines. However, all known dust collection systems create a suction or vacuum only at the peripheral edges of the member that contacts the surface to be treated. This results in an inefficient and frequently incomplete collection of dust particles generated.

Those concerned with this and other problems recognize the need for an improved dustless surface treating machine.

DISCLOSURE OF THE INVENTION

The present invention provides a dustless surface treating machine including a housing having a sealed vacuum chamber. A drive attached to the housing operates a driving member that in turn drives a surface treating member that has a lower face in contact with the surface to be treated. Both the surface treating member and the driving member have a plurality of openings that communicate between the treated surface and the vacuum chamber. A vacuum source is operably attached to the vacuum chamber so that particles from the treated surface are drawn directly through the openings into the vacuum chamber and are collected in a receptacle.

An object of the present invention is the provision of an improved dustless surface treating machine.

Another object is to provide a surface treating machine that pulls dust particles directly through the surface treating member.

A further object of the invention is the provision of a dustless surface treating machine that is uncomplicated in design and inexpensive to manufacture.

Still another object is to provide a dustless surface treating machine that provides a safe dust-free working environment.

A still further object of the present invention is the provision of a dustless surface treating machine that is easy to operate and maintain.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
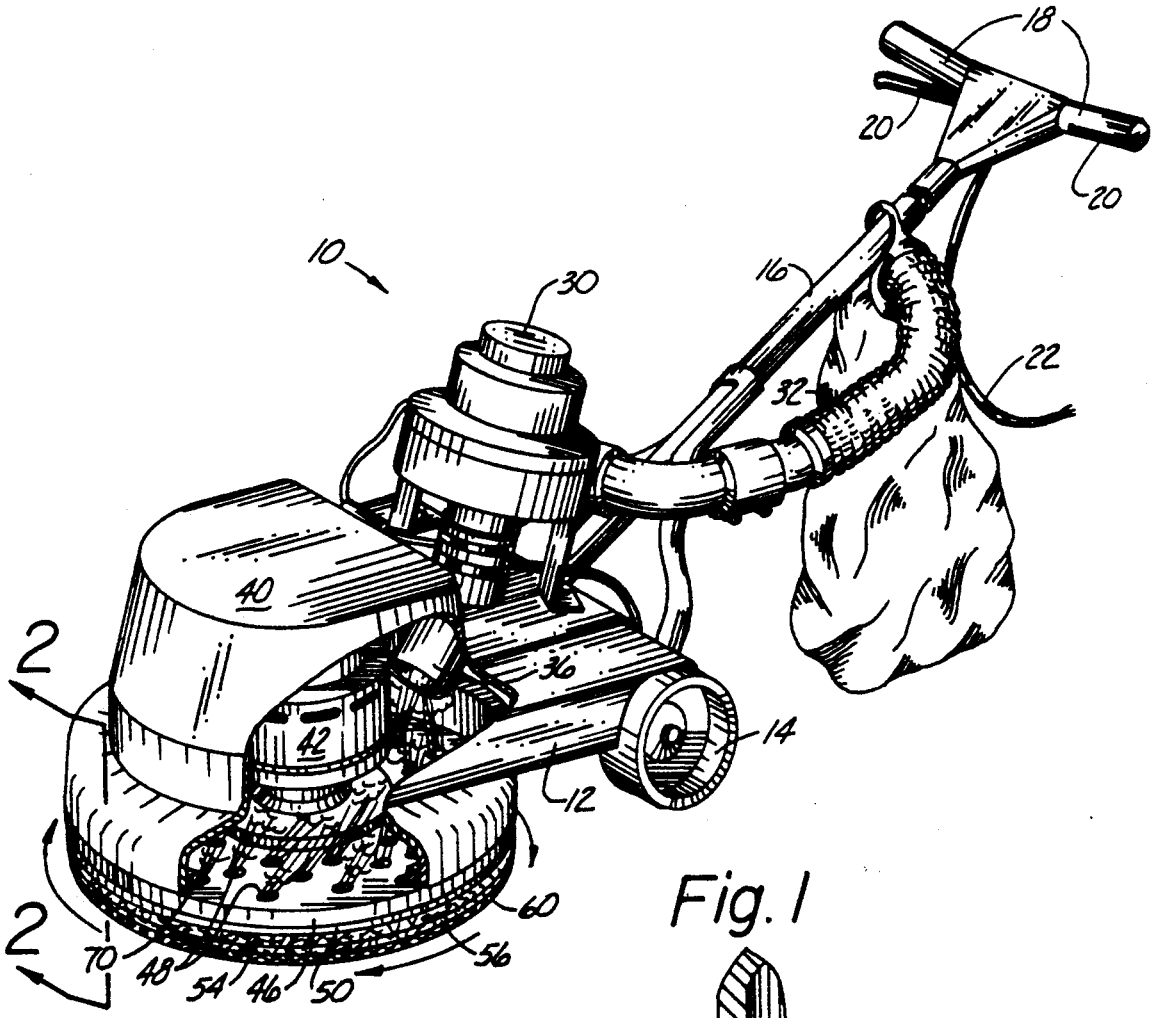
FIG. 1 is a perspective view of the dustless surface treating machine of the present invention with a portion cut away to show the vacuum holes formed through the driving member and the suction intake tube extending into the vacuum chamber at the top of the housing.

Referring now to the drawings, wherein like reference numerals designate identical or corresponding parts throughout the several views, FIG. 1 shows the dustless surface treating machine (10) of the present invention. Although a basic rotary floor buffer configuration is shown, it is to be understood that the invention could be used with various other surface treating machines of both the oscillating and rotary type. The machine (10) includes a frame (12) supported by retractable floor engaging wheels (14). A handle (16) extends up from the frame (12) and terminates in a pair of hand grips (18) that carry the machine controls (20). An electrical cord (22) extends from the top of the handle (46) for connection to a conventional power source (not shown). An electrical vacuum motor (30) is supported on the frame (12), and the discharge tube (32) and collection bag (34) are supported on the handle (16). The suction intake tube (36) extends through the housing (40). It is to be understood that the vacuum source could be located remote from the frame (12) so long as the suction intake tube (36) extends through the housing (40).

The housing (40) is carried on the front of the frame (12) and encloses the drive motor (42). A driving member (44) is operably attached to the motor (42) and includes a circular disc section (46) having a number of vacuum holes (48) formed therethrough and bristles (50) that extend down from the lower face. The bristles (50) are formed of Teflon ®, or other suitable material, which engages and holds a circular pad (52) in position. The pad (52) is made of suitable durable material such as a green Teflon ® pad (54) and a brown Teflon ® pad (56) secured together by gluing or other means. The pad (52) has a number of openings (58) formed therethrough in communication with the vacuum holes (48). A surface treating member, such as a sanding screen (60) is engaged and held in position by the pad (52). Openings (62) in the sanding screen (60) communicate with the openings (58) and vacuum holes (48).

Figure 2:
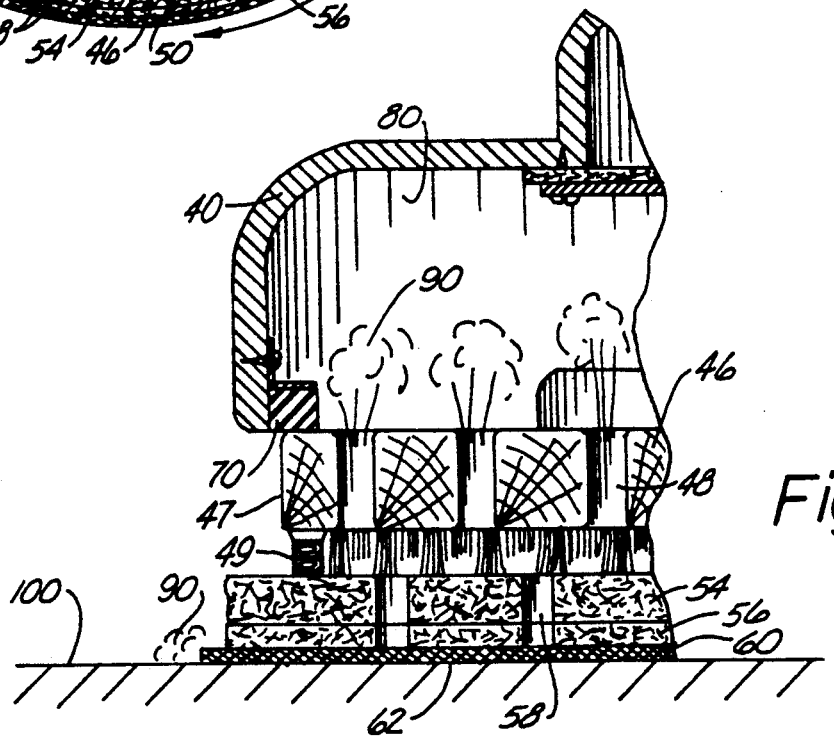
FIG. 2 is an enlarged sectional view taken along line 2—2 of FIG. 1 showing the orientation of the driving member, the intermediate pad, and the surface treating member, and showing the seal between the driving member and the housing and the seal between the driving member and the pad.
Figure 3:
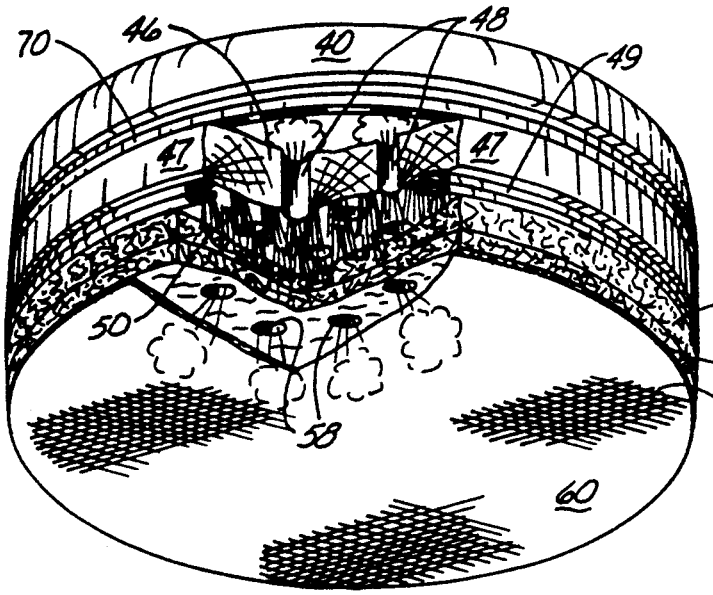
FIG. 3 is a partial perspective view from the underside of the machine with portions cut away to illustrate the arrangement of the components.
Figure 4:
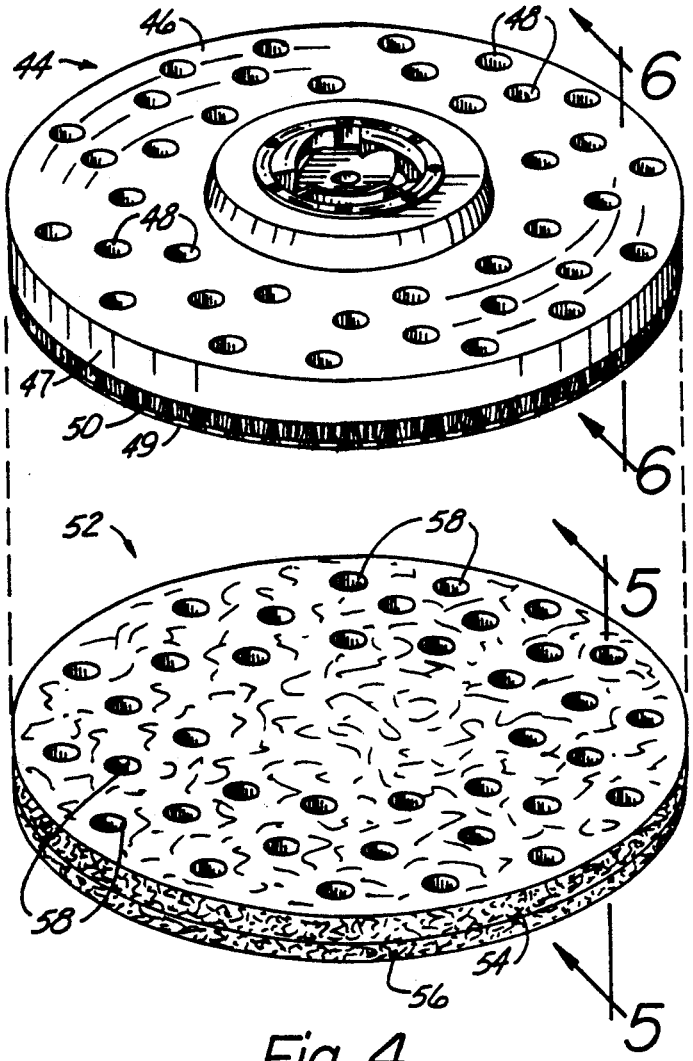
FIG. 4 is an exploded perspective view showing the driving member and the composite pad.
Figure 5:
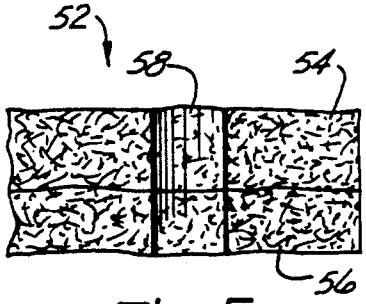
FIG. 5 is an enlarged sectional view taken along line 5—5 of FIG. 4 showing the composite pad.
Figure 6:
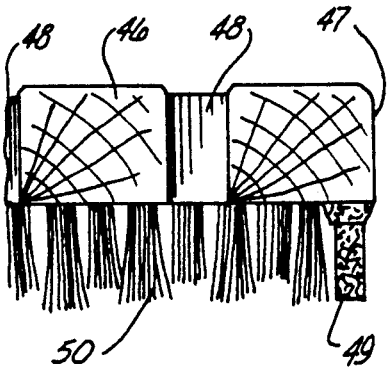
FIG. 6 is an enlarged sectional view taken along line 6—6 of FIG. 4 showing the driving member and the downwardly extending bristles.

Referring now to FIG. 2, it can be seen that a seal (49) extends down from the lower face of the driving disc (46) and extends around the disc (46) near its peripheral edge (47) to engage the top face of the pad (52). Housing seal (70) extends around the housing (40) to seal the space between the housing (40) and the top face of the driving disc (46). The interior of the housing (40) above the housing seal (70) defines the sealed vacuum chamber (80) which communicates with the suction intake tube (36).

In operation, the dust particles (90) generated by treatment of the floor surface (100) are carried directly through the openings (62) in the screen (60), through the openings (58) in the pad (52), through the vacuum holes (48) in the driving disc (46), and into the sealed vacuum chamber (80). The particles (90) then travel through the suction intake tube (36) and through the discharge tube (32) to the collection bag (34). The efficient removal of dust particles (90) from the floor surface (100) prevents the problem of air-borne particles (90) to enhance the working environment.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. A surface treating machine comprising:

a housing including a sealed vacuum chamber;

a drive attached to said housing;

a driving member operably attached to said drive, said driving member having a plurality of vacuum holes formed therethrough in communication with said vacuum chamber;

a surface treating member attached to and driven by said driving member, said surface treating member having a plurality of openings formed therethrough in communication with said vacuum holes and having a lower face disposed in contacting relationship with a surface to be treated; and a vacuum source operably attached to said housing and being disposed in communication with said vacuum chamber, wherein particles from the treated surface are drawn directly through the openings in the surface treating member, through the vacuum holes in the driving member, into the vacuum chamber, and are collected in a receptacle operably attached to said vacuum source.

2. The machine of claim 1 wherein said drive is an electric motor.

3. The machine of claim 1 wherein said driving member includes a circular disc.

4. The machine of claim 1 wherein the surface treating member is a circular sanding screen.

5. The machine of claim 1 wherein said vacuum source includes an electrical motor operably attached to said housing.

6. The machine of claim 3 wherein said driving member includes a plurality of downwardly extending bristles and wherein said machine further includes:

a circular pad having a top face disposed in contact with said bristles and a bottom face disposed in contact with the surface treating member, said pad including a plurality of openings formed therethrough in communication with the openings in said surface treating member and with the vacuum holes in said driving member.

7. The machine of claim 3 wherein said vacuum chamber is sealed by a housing sealing member attached to said housing and extending between the interior of said housing and a top face of said circular disc.

8. The machine of claim 6 further including a pad sealing member attached to said circular disc and extending between a lower face of said circular disc near a peripheral edge thereof and a top face of said pad.

9. The machine of claim 5 wherein said receptacle is attached to a handle extending up from said housing.

10. The machine of claim 1 wherein said machine includes floor engaging wheels attached to said housing.

* * * * *